US007229080B2

(12) United States Patent
Haugen

(10) Patent No.: US 7,229,080 B2
(45) Date of Patent: Jun. 12, 2007

(54) GOLF BAGS

(75) Inventor: Bernt Haugen, Heierstuveien 18, N-0880, Oslo (NO)

(73) Assignee: Bernt Haugen, Oslo (NO)

( * ) Notice: Subject to any disclaimer, the term of this patent is extended or adjusted under 35 U.S.C. 154(b) by 53 days.

(21) Appl. No.: 10/311,627

(22) PCT Filed: Jun. 27, 2001

(86) PCT No.: PCT/NO01/00272

§ 371 (c)(1),
(2), (4) Date: Aug. 11, 2003

(87) PCT Pub. No.: WO02/00310

PCT Pub. Date: Jan. 3, 2002

(65) Prior Publication Data

US 2004/0011929 A1 Jan. 22, 2004

(30) Foreign Application Priority Data

Jun. 27, 2000 (NO) ..... 20003362
Jun. 27, 2000 (NO) ..... 20003363
Jan. 24, 2001 (NO) ..... 20010432

(51) Int. Cl.
*B26B 1/00* (2006.01)

(52) U.S. Cl. ..... 280/47.26; 280/652; 280/DIG. 6; 280/47.26

(58) Field of Classification Search ..... 280/47.26, 280/652, DIG. 6, 30, 96; D3/255; D34/15
See application file for complete search history.

(56) References Cited

U.S. PATENT DOCUMENTS 1,865,689 A 7/1932 Hansen et al.
1,956,008 A * 4/1934 Deibel ..... 206/315.6
3,985,373 A * 10/1976 Widegren ..... 280/652
4,735,425 A * 4/1988 Hoff ..... 280/47.18
4,792,152 A 12/1988 Carolan
5,074,576 A * 12/1991 Finlay ..... 280/645
5,390,788 A 2/1995 Schenkkan
5,605,310 A 2/1997 Jungkind
6,641,228 B2 * 11/2003 Liu ..... 301/111.06
6,659,477 B2 * 12/2003 Jung ..... 280/47.26
6,672,600 B2 * 1/2004 Engelhardt et al. ..... 280/47.26
6,758,481 B2 * 7/2004 Blomgren ..... 280/47.26

FOREIGN PATENT DOCUMENTS

WO WO 95/30456 11/1995
WO WO 97/45311 12/1997

* cited by examiner

*Primary Examiner*—Christopher P. Ellis
*Assistant Examiner*—Cynthia F. Collado
(74) *Attorney, Agent, or Firm*—Timothy J. Keefer; Seyfarth Shaw LLP

(57) ABSTRACT

A golf bag assembly including a frame with demountable wheels (2) and wheel struts (5), wherein the wheels (2) and wheel struts (20) may be disassembled and stored inside the bottom of the golf bag, represents an improvement with respect to function and space taken up by the golf bag e.g. inside a car trunk. Such a bag may also be equipped with supporting legs, where such legs optionally, but preferably, may be extended from a resting position to an operating position for supporting the golf bag during use in an inclined, upright position.

10 Claims, 6 Drawing Sheets

FIG. 1
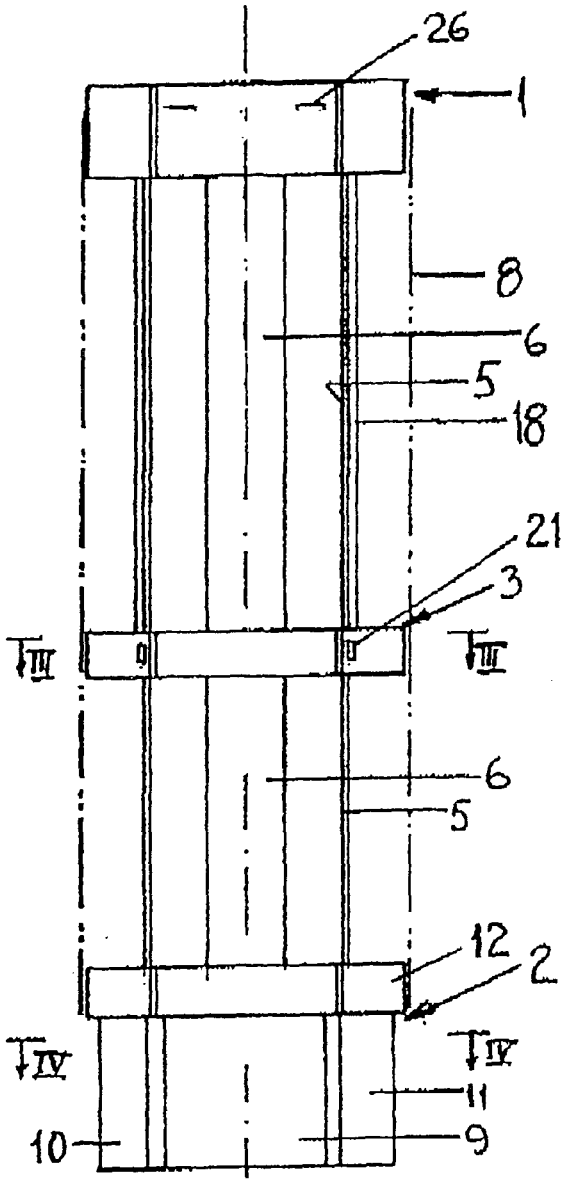
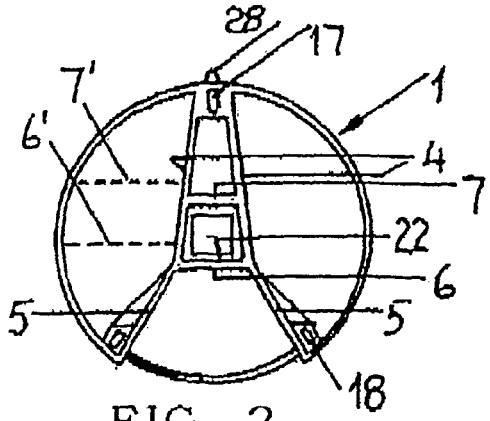
FIG. 2
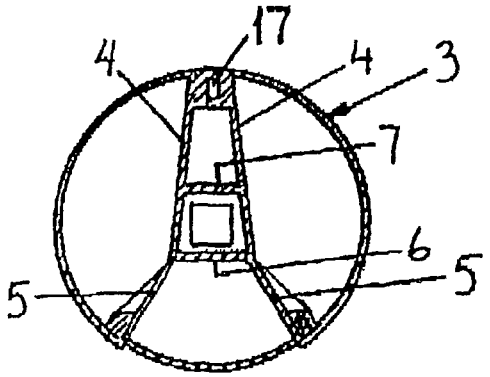
FIG. 3
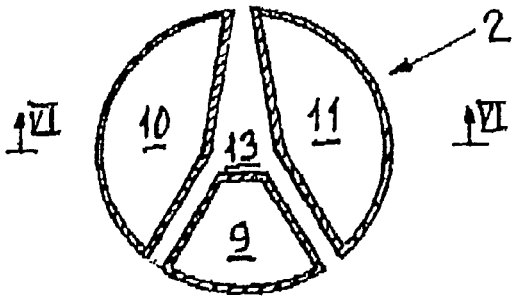
FIG. 4
FIG. 5
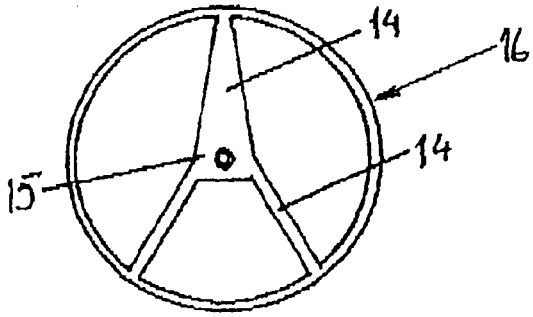

FIG. 7
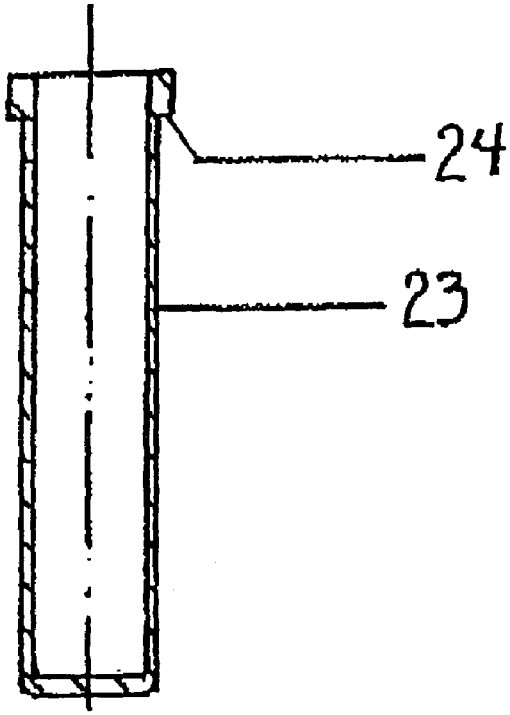
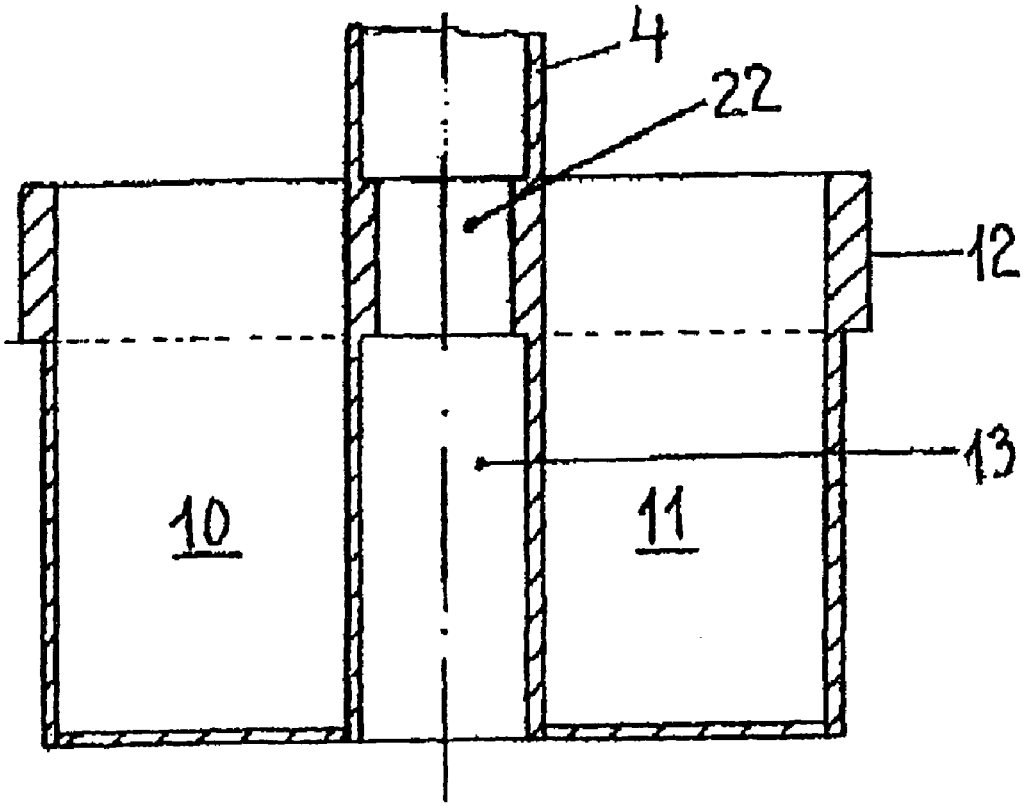
FIG. 6

FIG. 11
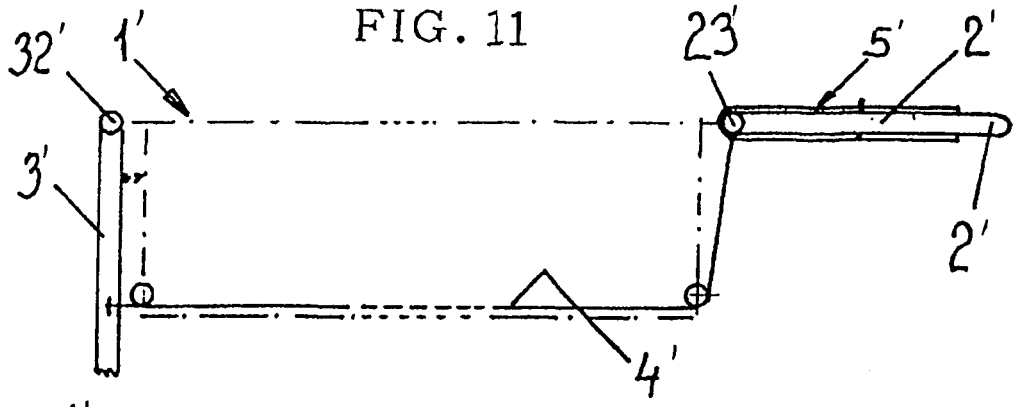
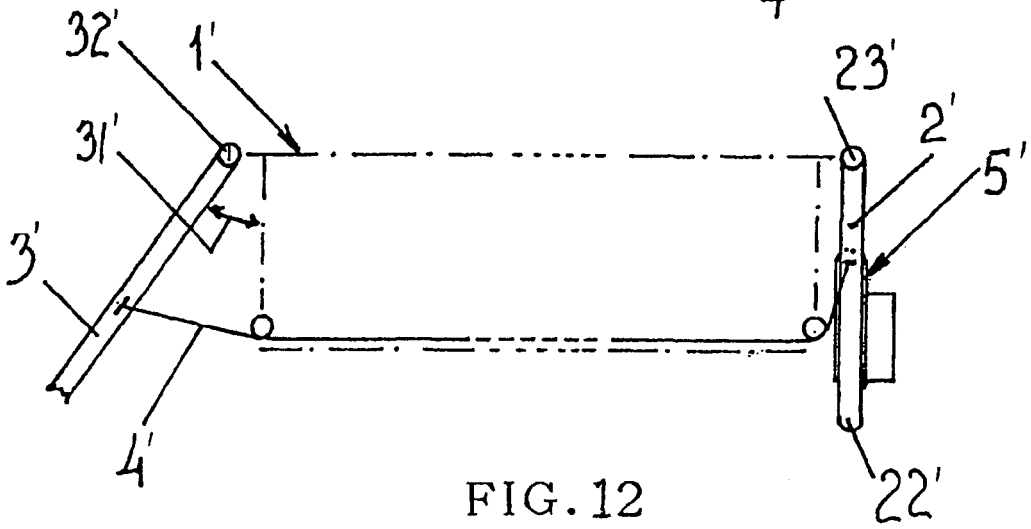
FIG. 12

GOLF BAGS

CROSS REFERENCE TO RELATED APPLICATION

This application claims the priority of Norwegian patent application Ser. Nos. 20003362 and 20003363, filed on Jun. 27, 2000, and Norwegian patent application Ser. No. 20010432, filed on Jan. 24, 2001.

FIELD OF THE INVENTION

The present invention relates to the construction of a golf bag including a wheel assembly and optionally including supporting braces for supporting the golf bag in a substantially upright position.

DESCRIPTION OF THE RELATED ART

There are known a number of different constructions for golf bags, inter alia stiff and soft ones, and there are known several devices for mounting both straps and/or wheels as well as supporting braces on such bags.

A general consideration concerning such golf bags is that the bags are to occupy as little space as possible when disassembled/demounted while at the same time being capable to include the golf clubs as well as the wheels and supporting braces.

From e.g. SE B 3.836.683 and U.S. Pat. No. 4,792,152 there is known a golf bag with an opening in its one end and a solid and impenetrable bottom in its opposite end, wherein the bag comprises a stiff frame and a holster and wherein the bag is equipped with demountable rolling wheels which, when disassembled, may be received coaxially with the frame in its bottom part. The rolling wheels are designed to be mounted in a demountable fashion on the frame, and the frame is, from its opening and to its bottom, equipped with a guiding rail for a slideable handle, and receiving the demounted wheel braces, respectively. However, although the wheels according to these constructions may be demounted and stored at the bottom or inside the golf bag, a general concern is that the accessibility of such wheels (as well as the different parts for the frame/carrier of the bag) is limited and the parts are cumbersome to handle when assembling the frame/carrier.

Consequently there exists a need for an improved golf bag wherein the frame and wheels are readily accessible for assembly and where the entire golf bag, when disassembled and demounted, holds up a minimum of space for transport in a convenient manner, and where the assembly of the golf bag frame together with the golf bag is done neatly and economically.

SUMMARY OF THE INVENTION

One of the aspects of the present invention is consequently to provide the golf bag with rolling wheels wherein the wheels are suited to be stored inside the bottom of the golf bag when disassembled and remounted in its storage mode, and where the golf bag furthermore includes an internal space to store struts for the wheels to be mounted onto the frame of the golf bag, and wherein the bottom section of the golf bag is formed as receiving cups which between their adjacent side walls have apertures that in is their dimensions and orientation correspond to spokes and hub in the demounted roller wheels, and preferably the roller wheels have spokes that protrude from the hub mainly in the form of a Y, and wherein the space between cups in the bottom part have a corresponding Y-shape.

BRIEF DESCRIPTION OF THE DRAWINGS

Further features and advantages relating to the invention will become apparent from the patent claims as well as from the disclosure following infra in connection with the enclosed figures relating to an embodiment of the invention.

FIG. 1 shows a drawing of a frame of a golf bag in accordance with the invention.

FIG. 2 shows an end view of the frame from FIG. 1.

FIG. 3 shows a sectional view through the line III—III in FIG. 1.

FIG. 4 shows a sectional view through the bottom part of the frame through the line IV—IV in FIG. 1.

FIG. 5 shows a side view of a wheel to be used in connection with the bag frame according to FIG. 1.

FIG. 6 shows an axial section through the bottom part of the frame through the line VI—VI in FIG. 4.

FIG. 7 shows, in an axial view, a release element.

FIGS. 11 and 12 show an embodiment of the golf bag according to the invention including a further improvement comprising extendable supporting legs and a securing loop for a carrier strap, with the legs in a retracted and unfolded position, respectively.

DETAILED DESCRIPTION OF THE INVENTION

Figure 8:
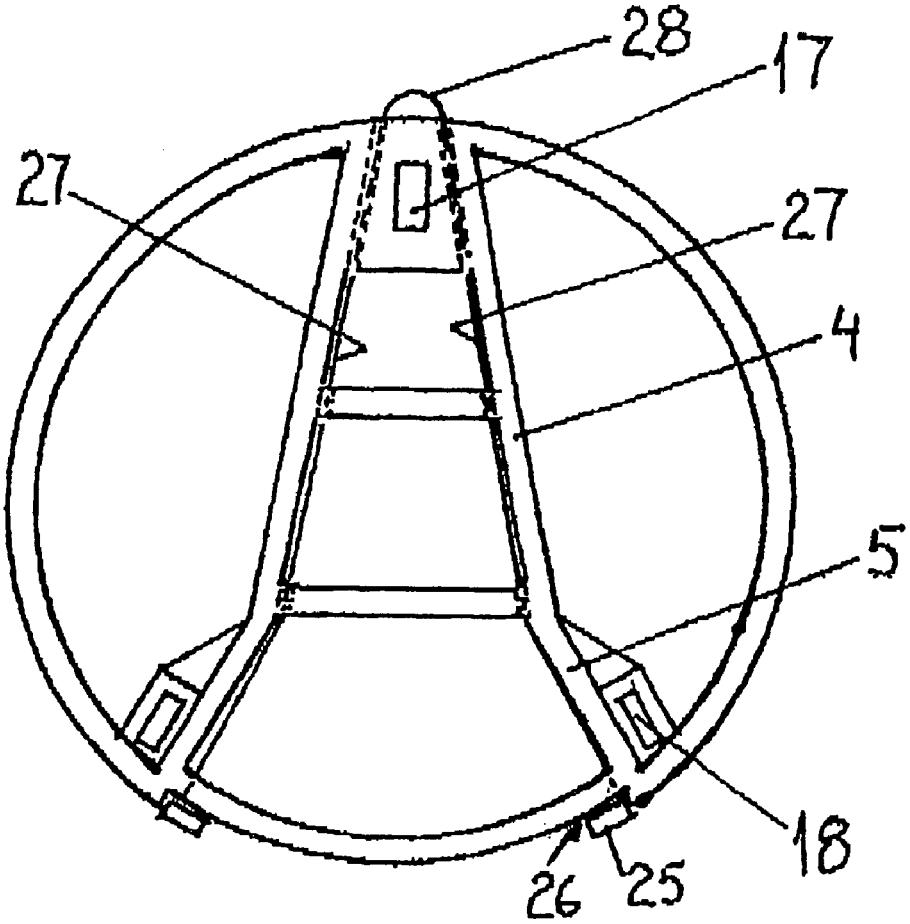
FIGS. 8 and 9 show, in a larger scale, details in connection with the securing for the carrier strap and foldable supporting legs.
Figure 9:
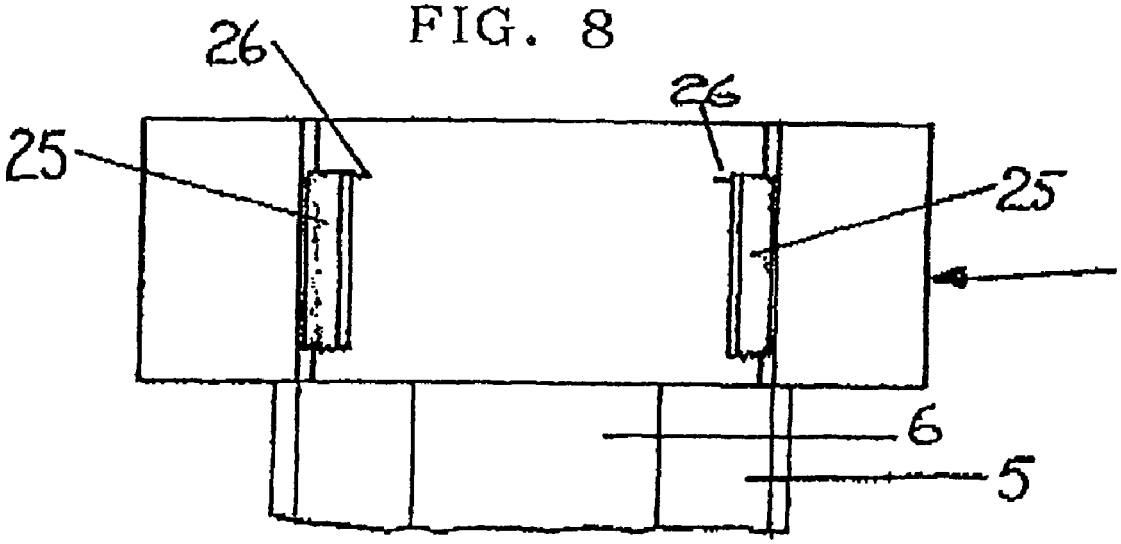
Figure 10:
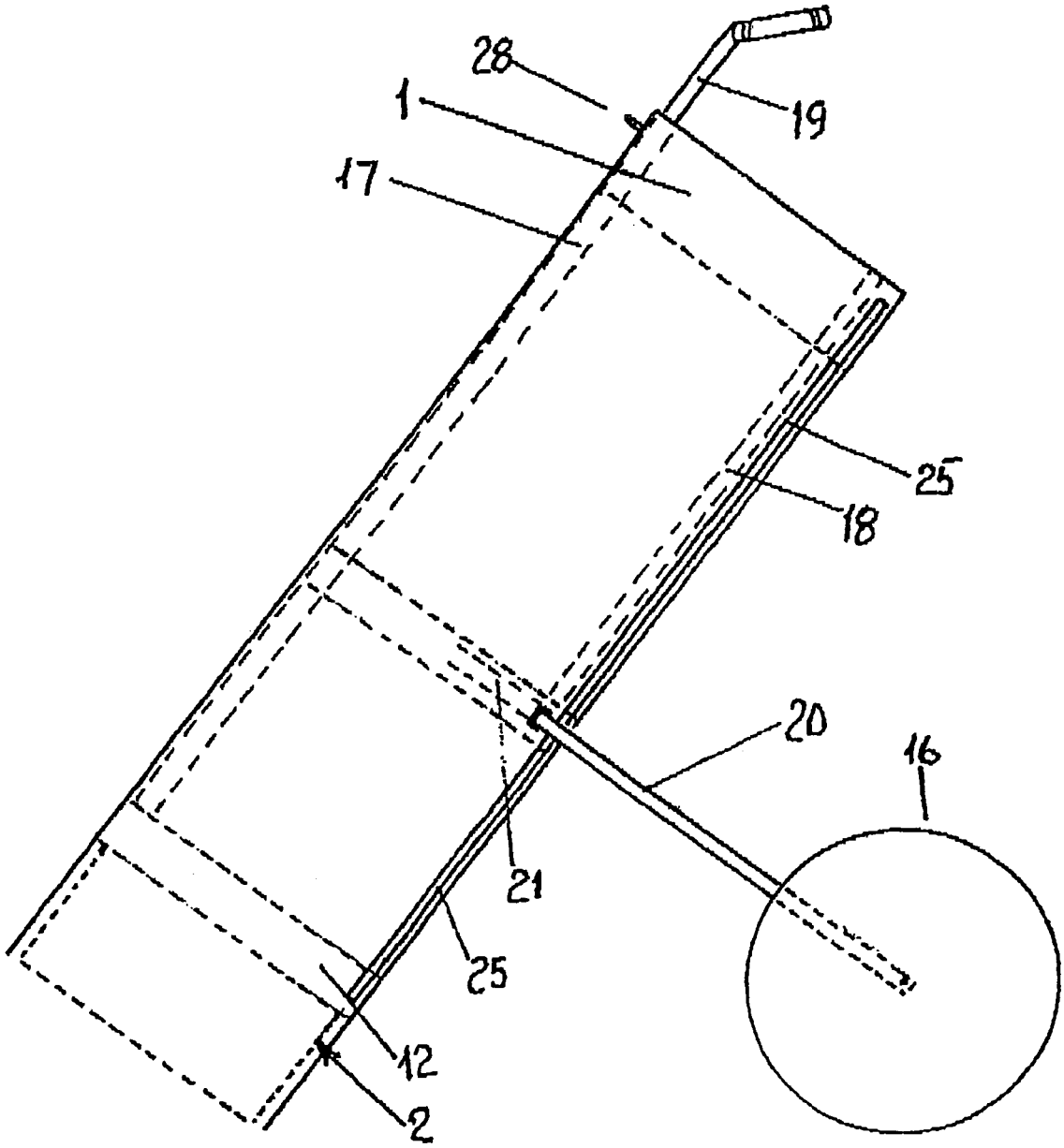
FIG. 10 shows an outline of a golf bag in accordance with the invention with wheels mounted.

With reference to FIGS. 1–10, and especially FIGS. 1–4, a rigid frame to be used in a golf bag according to the present invention comprises a top ring element 1 for the opening of the bag, a cup-formed bottom part 2 and an intermediate ring element 3 being located axially with respect to each other. The assembly comprises furthermore a number of axially placed walls 4,5,6,7 running from the top ring element 1 through the intermediate ring element 3 to the bottom part 2. Two walls 4 converge towards each other from a central area around the axis of the frame to the external limit of the frame, wherein said external limit also is defined by e.g. the top ring element 1 and the intermediate element 3. Two walls 5 diverge from each other from the central area towards the external limit, opposite with respect to first mentioned walls 4, and the walls 4,5 are located symmetrically around a common plane of symmetry. The walls 6 and 7 are located between the walls 4 across from said plane of symmetry. Further cross walls may optionally be placed outside the walls 4 for further sectioning the volume of the bag, e.g. as indicated in dotted lines 6',7' in FIGS. 3 and 4. The frame is surrounded by a rigid sheath or a soft or a semi-soft sheath 8. The sheath 8, being indicated by dotted lines, is secured conveniently to the frame. The walls 4,5,6,7 (and the optional further cross walls) limit, together wit the sheath 8 and the bottom part 2, a number of rooms or pockets for storing golf clubs or other items. The central pocket serves for receiving a club with a relatively short handle, e.g. a putter, for a purpose to be explained infra under reference to FIGS. 6 and 7.

The bottom part is, in the indicated embodiment, formed as three cups 9,10,11 being reciprocally connected by an upper edge ring 12 and a hub part 13 which between their respective side walls include spaces which in their orientation and dimensions correspond to spokes 14, and the hub 15 in the demountable wheels 16 of the bag (FIG. 5). The height of the walls in the cups 9–11 is twice the width of the wheels 16. The two wheels of the bag will thus, in their demounted mode, be pushed inside the bottom part 2 of the bag with spokes and hub housed in the spaces between the cups 9–11 in the bottom part.

According to the invention the frame is, from the opening and towards the bottom, equipped with leads or channels 17, 18, respectively, for a extendable/retractable handle 19, or for receiving a wheel strut 20 in the demounted mode.

The lead 17 for the extendable/retractable handle 19 may run from the top ring element 1 and well past the intermediate ring element 3, whereas the leads 18 for the wheels 20 may run from the top ring element 1 to the intermediate ring element 3. Immediately below the lower or inner end of the strut leads 18, there is located mainly radially extending leads 21 running from the outer circumference of the intermediate ring element and inwards along the walls 5, and serve for receiving one end of each wheel support 20, whereas the wheels 16 of the bag with their hubs 15, may be detachably mounted on pins at the opposite end of the supports/struts 20.

The handle of the golf bag may preferably be located at the apex of the golf bag when the bag is placed in a reclined position with an angle to the ground, optionally when the golf bag is used as a pullcart. In this position the handle will be located diagonally opposite the wheels of the golf bag or the wheels of the frame, or will be located opposite the braces of the golf bag. By placing the handle in this position it is achieved the advantage the handle may be made smaller, and the handle may also be equipped with a plastic sheet or tarpaulin for protecting the golf clubs inside the bag against precipitation such as rain or snow. However, the handle may also be placed at any other convenient location, e.g. at the sides of the golf bag or optionally also as an addition to the frame to which the golf bag is mounted.

At the bottom or innermost in the central room being formed between the walls 4,5,6,7, there is present a somewhat narrowed passage 22 (FIG. 6) towards the hub part 13 in the bottom part 2 for positioning a release element 23 (FIG. 7). When mounting the wheels 16 onto the cups in the bottom part 2, the hub part 15 of the wheels pushes the release element 23 backwards. When releasing the wheels 16 from the bottom part 2, the release element 23 is pushed out by using the handle of a golf club, e.g. a putter, a collar 23 on the release element, by acting on the edge of the narrowed opening 22, preventing the release element to be pushed too far out.

In an alternative embodiment the golf bag according to the invention (or also a conventional golf bag comprising a rigid frame and a soft, semi-soft or stiff sheath and being equipped with a securing loop for a carrier strap) is equipped with at least one and preferably two extendable supporting legs being secured with a hinge to the bag or the frame. The supporting legs may include a resilient element, e.g. a spring, extending the legs and being secured by the fastening loop for the carrier strap for being pulled against the bag when operating the carrier strap. What mainly is characterising for this embodiment of the invention is that the supporting leg or legs is/are connected to the securing loop for the carrier strap through a wire or similar element which is led mainly diametrically or cordially through the upper part of the bag. In an alternative embodiment the securing loop is elongated with mutually parallel branches. Between the two branches of the securing loop there is place a glider whereto the wire is secured. This glider is designed for a sliding movement back and forth between the two parallel branches of the securing loop for loosening and tightening of the wire.

With reference to FIGS. 11 and 12, these figures show a schematic side view of the opening part of a golf bag with extendable supporting legs and a securing loop for a carrier strap, with the legs in a indrawn respective extended position.

Figure 15:
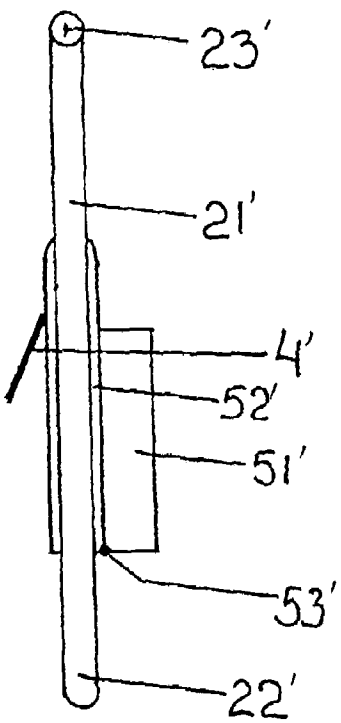
FIGS. 14 and 15 show a side view of the securing loop in FIG. 3 with the sliding part in its one or second position, respectively.
Figure 14:
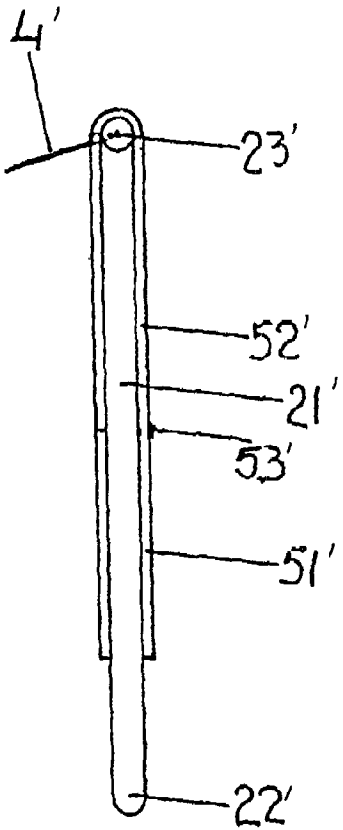
Figure 13:
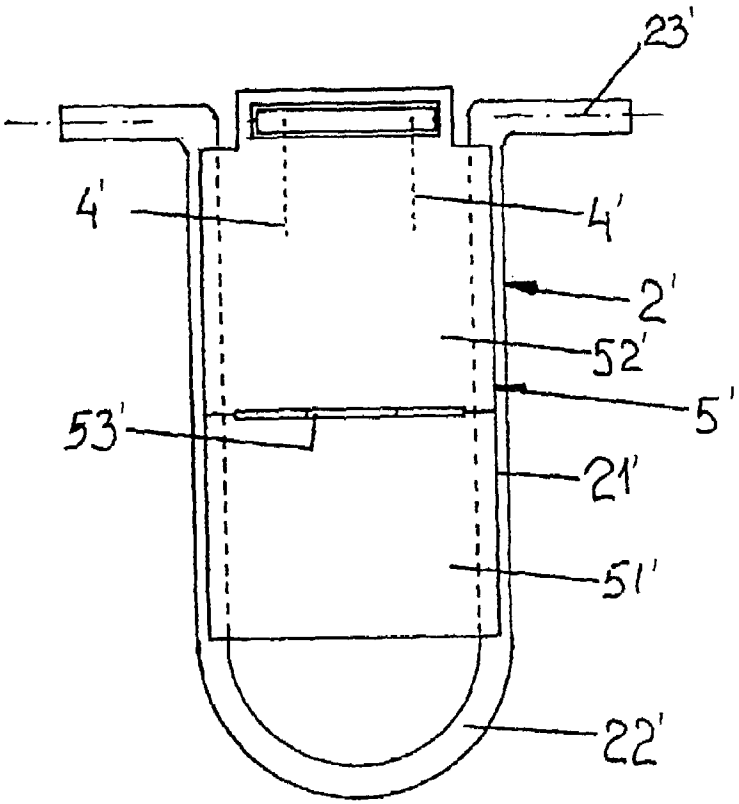
FIG. 13 shows a frontal view of a securing loop with a slideable part for tightening the retracting wire for the supporting legs.

FIG. 13 shows a frontal view of a securing loop with a glider for tightening the collecting wire for the supporting legs, whereas FIGS. 14 and 15 show a side view of the securing loop in FIG. 13 with the glider in each of the first and second positions, respectively.

On a golf bag in the form of a rigid sheath or in the form of a softer holster with a rigid frame, there is at the top opening 1' of the bag, indicated with a dotted line, on one end arranged a securing loop 2' for a carrier strap (not shown), and on the opposite side from the hinge securing point there are located two supporting legs 3'. When said legs are folded out from the bag, they will provide an adequate support for a bag standing in an inclined position. To prevent the supporting legs from spreading outwards when the bag is carried, the supporting legs 3' are connected by e.g. a wire to the carrying loop 2' for the carrier strap, so that the supporting legs 3' are retracted towards the body of the bag when the bag is lifted by the carrier strap since the wire then will draw the legs in towards the bag body. The wire 4' extends mainly diametrically or cordially through the upper part of the bag. When the bag again is placed on the ground, the legs may manually be extended or by there being placed a spring device 31' between the bag and the legs, e.g. in connection with the legs' hinges 32'. For preventing the legs 3' from unintentionally being extended from the bag, e.g. during transport, it is convenient to provide e.g. a Velcro-strap on the bag near the free end of the support legs in their retracted, non-operative position.

The securing loop 2' for the carrier strap is conveniently, as shown in more detail in FIGS. 13–15, formed elongated with reciprocally parallel branches 21' between an outer, curved securing part 22' for the carrier strap, and an inner end where the securing loop is hinged, at 22', to the opening part 1' of the bag. Between the two mutually parallel branches 21' there is mounted a glider 5' to which the wire 4' is secured for displacement between an outer position where the wire 4' through operating the securing loop 2' may be loosened for extending the supporting legs 3', and an inner position where the wire is tightened whereby the legs are withdrawn in towards the bag and wherein the glider 5' may be locked with respect to the securing loop 2'. In the shown embodiment the glider is formed by two parts 51',52' being mutually hinged at 53' about an axis running across the parallel branches 21' of the securing loop 2', and so that the outer part 51' of the glider 5' in this locking position, lies along the inner part of the glider between and in locking position with the two parallel branches 21' of the securing loop, whereas the external glider part 51', when the glider is to be liberated, is turned outwards about the hinge 53' and out from attachment to the securing loop branches 21', whereby the glider may be displaced with respect to the securing strap.

The invention claimed is:

1. A device for use in a golf bag, comprising a frame and at least one wheel (16) demountably coupled to the frame, the wheel (16) including a hub (15) and an arrangement of spokes (14) intersecting the hub (15), the frame including a bottom part (2) having:

a plurality of adjacent cups (9, 10, 11), each cup having a sidewall; and a space separating sidewalls of the adjacent cups (9, 10, 11), the space being shaped for receiving therein the hub (15) and the arrangement of spokes (14) in the at least one wheel (16).

2. The device of claim 1, wherein the frame further comprises at least one slide (18) extending along the frame and a strut (20) demountably received in the at least one slide (18) for demountably attaching the at least one wheel (16) thereto.

3. The device of claim 1, wherein the frame is substantially rigid and is surrounded by a sheath or holster (8).

4. The device of claim 3 wherein the frame further comprises a plurality of walls (4, 5, 6, 7) extending in a direction substantially parallel to a longitudinal axis of the frame in an interior of the frame to form a pocket in the interior of the frame.

5. The device of claim 1 further including at least one slide (17) extending along the frame for receiving a retractable handle (19) therein.

6. The device of claim 1, wherein the frame further comprises at least one guide (21) extending in a direction substantially orthogonal to a longitudinal axis of the frame, for receiving at least one strut (20) therein.

7. The device of claim 1, wherein the bottom part further includes a passage (22) for receiving an expelling element (23) therein for expelling the hub (15) and the arrangement of spokes (14) received in the space.

8. The device of claim 1, further comprising a handle coupled to the golf bag diagonally opposite the at least one wheel.

9. A device for use in a golf bag, comprising a frame and at least one wheel (16) demountably coupled to the frame, the wheel (16) including a hub (15) and an arrangement of spokes (14) intersecting the hub (15), the frame including a bottom part (2) having:

a plurality of adjacent cups (9, 10, 11), each cup having a sidewall; and a space separating sidewalls of the adjacent cups (9, 10, 11), the space being shaped for receiving therein the hub (15) and the arrangement of spokes (14) in the at least one wheel (16), wherein the arrangement of spokes (14) intersects the hub (15) of the at least one wheel (16) to form a "Y"-shape, and the space separating the sidewalls of the adjacent cups (9, 10, 11) forms a complementary "Y"-shape for receiving the hub (15) and the arrangement of spokes (14) therein.

10. A device for use in a golf bag, comprising a frame and at least one wheel (16) demountably coupled to the frame, the wheel (16) including a hub (15) and an arrangement of spokes (14) intersecting the hub (15), the frame including a bottom part (2) having:

a plurality of adjacent cups (9, 10, 11), each cup having a sidewall;

a space separating sidewalls of the adjacent cups (9, 10, 11), the space being shaped for receiving therein the hub (15) and the arrangement of spokes (14) in the at least one wheel (16); and a passage (22) for receiving an expelling element (23) therein for expelling the hub (15) and the arrangement of spokes (14) received in the space.

* * * * *